United States Patent [19]

Witt et al.

[11] 4,090,526

[45] May 23, 1978

[54] GAS PRESSURE STABILIZER SYSTEM AND VALVE

[75] Inventors: Chester J. Witt, Chicago; Richard M. Thompson, Schiller Park, both of Ill.

[73] Assignee: Mojonnier Bros. Co., Chicago, Ill.

[21] Appl. No.: 714,906

[22] Filed: Aug. 16, 1976

Related U.S. Application Data

[63] Continuation of Ser. No. 565,522, Apr. 7, 1975, abandoned.

[51] Int. Cl.[2] ..... B67D 5/34

[52] U.S. Cl. ..... 137/209; 141/46

[58] Field of Search ..... 137/115, 116.3, 209, 137/510; 141/46; 251/61.1, 61.2, 61.3

[56] References Cited

U.S. PATENT DOCUMENTS

| | | | |
|---|---|---|---|
| 1,871,535 | 8/1932 | Lattner | 137/116 |
| 2,318,066 | 5/1943 | Dodd | 137/209 X |
| 2,369,994 | 2/1945 | Whitney | 251/61.1 X |
| 2,577,967 | 12/1951 | Hughes | 251/61.2 X |
| 2,902,048 | 9/1959 | Ryan | 137/510 |
| 2,946,186 | 7/1960 | Southam | 137/501 X |
| 3,078,066 | 2/1963 | Moore | 251/61.1 |
| 3,094,281 | 6/1963 | Myers | 137/209 X |
| 3,520,321 | 7/1970 | Skoli et al. | 137/116 |
| 3,818,929 | 6/1974 | Braukmann | 137/218 |
| 3,933,277 | 1/1976 | Volat et al. | 137/115 X |

FOREIGN PATENT DOCUMENTS

| | | | |
|---|---|---|---|
| 933,405 | 4/1948 | France | 137/510 |
| 842,160 | 7/1960 | United Kingdom | 251/61.1 |

*Primary Examiner*—Alan Cohan
*Assistant Examiner*—Gerald A. Michalsky
*Attorney, Agent, or Firm*—Olson, Trexler, Wolters, Bushnell & Fosse, Ltd.

[57] ABSTRACT

A gas pressure stabilizer system and valve are disclosed for use with beverage bottle filling apparatus and the like. Gas flow from a pressurized source to a filler bowl is permitted along a conduit, but reverse flow, caused by filler bowl gas pressure fluctuation, is prohibited by a check valve. Rather, a rise in filler bowl gas pressure forces a diaphragm in a stabilizer valve to move away from and uncover a relief port. This port opening permits excessive gas pressure to be vented. Long system service life is encouraged by forming the diaphragm of several membranes.

6 Claims, 2 Drawing Figures

FIG. 1
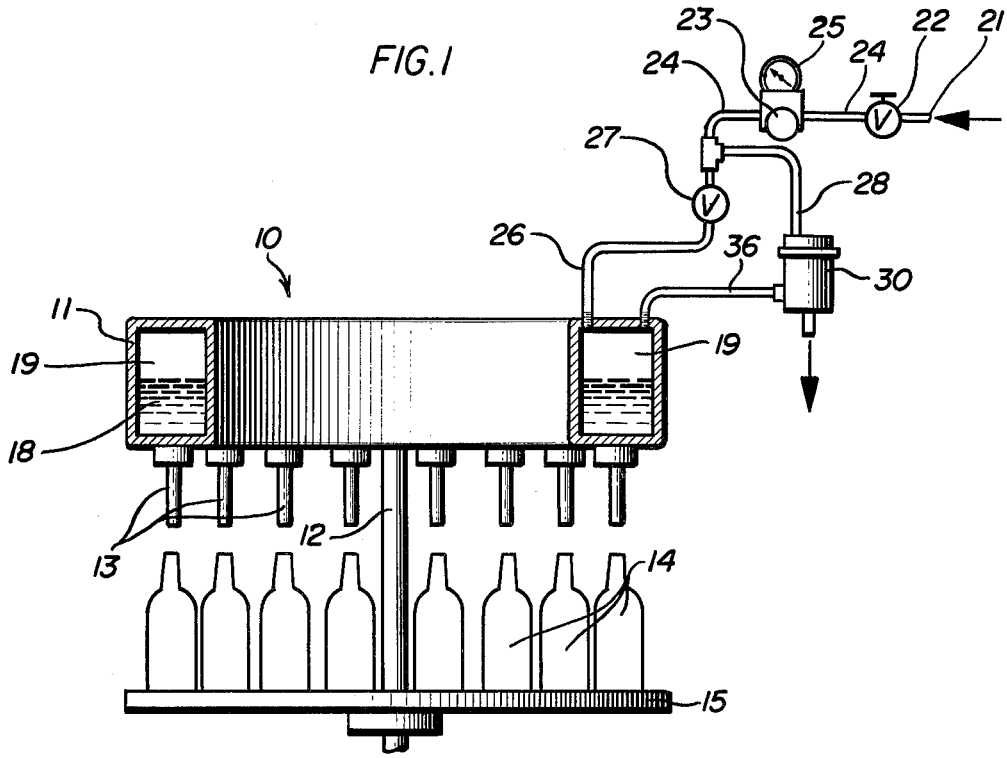
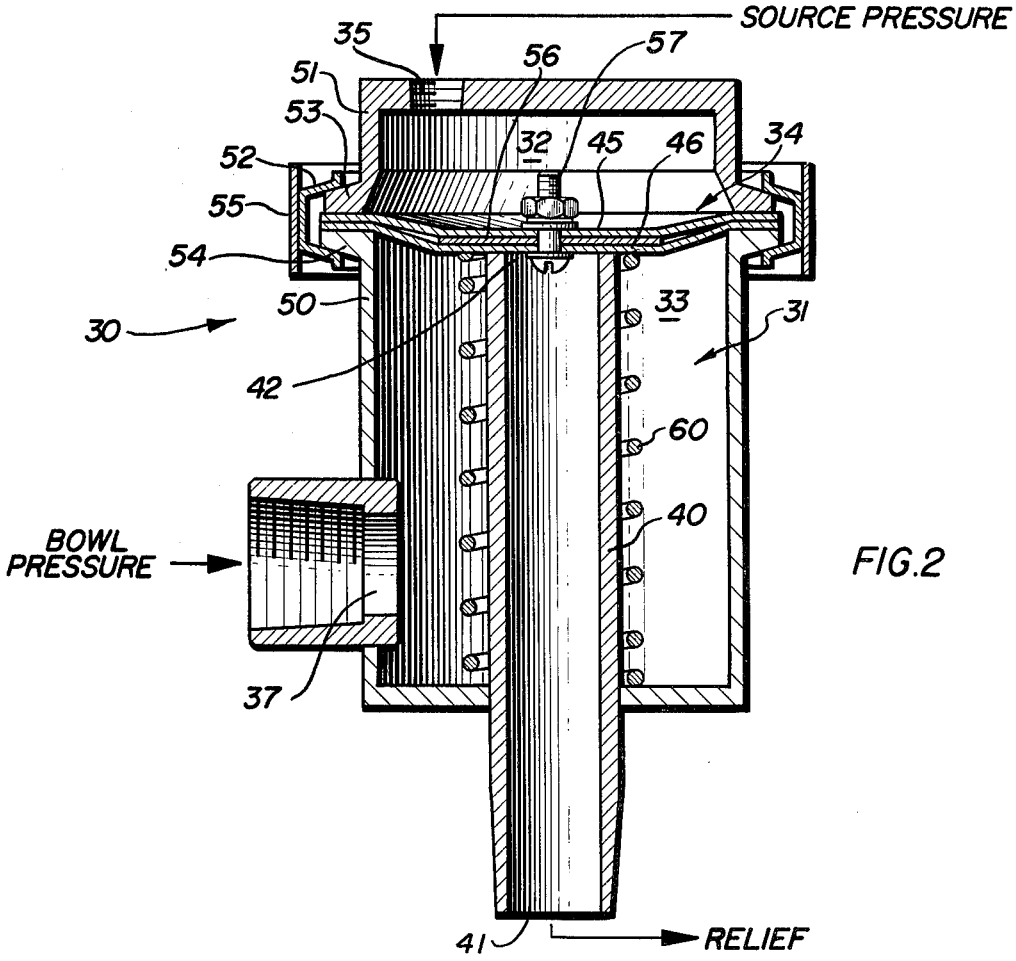
FIG. 2

GAS PRESSURE STABILIZER SYSTEM AND VALVE

This is a continuation of application Ser. No. 565,522, filed Apr. 7, 1975, now abandoned.

BACKGROUND OF THE INVENTION

This invention relates generally to apparatus for controlling fluctuating gas pressures and more particularly to devices for controlling gas pressure in a carbonated beverage packaging filler bowl.

Modern apparatus for filling beverage containers such as soda pop bottles and the like must operate with great reliability and precision at high speed. The addition of carbonation causes a positive gas pressure within the finally filled container. Under these circumstances, careful control of gas pressure within the filling apparatus and within the associated bottle or other container being filled is necessary.

In many carbonated filler installations, air, nitrogen or other gases originally contained within the empty beverage bottle or container is passed into the filling apparatus from the individual container as it is filled with liquid. Apparatus for controlling these gas pressures during bottle filling must be rugged yet permit precise control of gas pressures within the filling apparatus. One such device which has met with great commerical success is disclosed in U.S. Pat. No. 3,520,321 to Skoli et al.

It is the general object of the present invention to provide a reliable and rugged yet highly sensitive gas pressure control apparatus for use with filler bowl apparatus and the like.

A more specific object of the invention is to provide such gas pressure control apparatus wherein gas venting relief occurs at a relatively low actuating pressure differential between ports of a stabilizer valve. In the embodiment of the invention here illustrated and described this pressure differential can be on the order of 1 or 2 psi.

Yet another object of the invention is to provide such a system wherein the noise of apparatus operation and gas venting is minimized. An associated object is to provide such apparatus which does not require a noise muffler.

It is another object of the invention to provide such gas pressure control apparatus in a form which eliminates gas flow from a pressurized gas source to a receiving filler bowl through a stabilizer valve. An associated object is to provide such apparatus wherein gas flow through the pressure stabilizer valve is entirely eliminated save for venting action.

Yet another object is to provide such apparatus wherein the stabilizer valve itself is of light weight. In the illustrated and described embodiment of the invention, the valve can be made to weigh no more than several pounds.

A further object is to provide such apparatus which is inexpensive in initial cost, yet reliable and rugged in operation. An associated object is to provide such apparatus wherein wear of moving valve parts is minimized.

Other objects and advantages of the invention will become apparent upon reading the following detailed description and upon reference to the drawings. Throughout the description, like reference numerals refer to like parts.

BRIEF DESCRIPTION OF THE DRAWINGS

FIG. 1 is an elevation view in partial section showing the novel apparatus and valve as they appear during use with beverage container filling apparatus; and FIG. 2 is an enlarged elevational view in section of the pressure controlling and stabilizing valve shown in FIG. 1.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Turning first to FIG. 1, there is shown a beverage container filler 10 which here includes a hollow, annular filler bowl 11 mounted for rotation with a vertical pipe 12. A suitable number of filler nozzles 13, arranged in a circle about the bottom of the filler bowl 11, deliver a carbonated or otherwise pressurized beverage liquid to associated bottles 14. These bottles 14 are supported upon a platform 15 for rotation with the pipe 12, bowl 11 and nozzles 13.

During operation of the invention, it is contemplated that the filler bowl 11 will contain a beverage liquid 18 below a head space 19 which is maintained at a positive gas pressure. To maintain this pressure, a gas, such as carbondioxide, flows at a positive pressure from a remote gas source 21 through a shut-off valve 22 and a pressure regulator 23 via a conduit 24 to this head space 19. A monitoring gauge 25 can be provided to indicate system gas pressure.

Most efficacious bottle filling or container packaging occurs when the gas pressure within the filler bowl head space 19 is maintained at a relatively constant pressure. However, operating experience has shown that this head space pressure fluctuates when surges of liquid are added during bowl refilling or removed during rapid bottle filling. Pressure surges are also caused by the back-flow of gas within the bottles into the filler bowl as liquid flows into the bottles and displaces the gas in the bottles. It is a feature of the invention that gas can be routed from the source 21 to the filler bowl head space 19, but back flow of gas from the bowl 11 to the source 21 can be prevented. To this end, a one-way conduit — here, a pipe 26 — permits the flow of pressurized gas from the source 21 to the bowl 11, but a one-way check valve 27 is interposed within the conduit 26 to check or inhibit gas flow from the bowl head space 19 toward the source 21. A second conduit 28 leads gas to a pressure stabilizing valve 30.

In accordance with the invention, this stabilizer valve 30 provides quiet, trouble-free pressure stabilizing action to the system. As explained above, a stabilized bowl head pressure encourages rapid and proper container filling. To this end, the valve 30 comprises a hollow interior 31 divided into two chambers 32 and 33 by a multimember diaphragm 34 extending across the valve body interior 31. A first chamber 32 is maintained at the gas-source pressure by gas communication with the source 21 through the conduits 24 and 28 and a first valve port 35. This port 35 permits pressurized gas flow and pressure equalization between the pressure supply source 21 and the first valve chamber 32. In a similar manner, the second chamber 33 is maintained at a gas pressure similar to that found in the filler bowl head space 19. This is accomplished in the present invention through a conduit 36 which connects through a second port 37 to the second chamber 33. As can be envisioned from FIG. 2, the position of this diaphragm 34 is related to the sensed differential in pressure across the diaphragm or between the first chamber 32 and second chamber 33.

It is a feature of the invention that a pressure rise within the filler bowl head space 19 to a pressure greater than the gas pressure source causes system venting or gas discharge to the environment outside the valve 30. To this end, a pressure release tube 40 extends into and through the second valve chamber 33 from an outside nozzle end 41 to an interior port face 42. As can be seen particularly from FIG. 2, this port face 42 is located at a position for abutting engagement by the diaphragm 34, yet the port 42 is separated from the valve body interior walls to provide positive, reliable valve action. As can be envisioned, when the pressure in the second chamber 33 rises above the pressure in the first chamber 32, the diaphragm 34 moves from its illustrated port-closed to a port-opened position to vent gas to the environment outside the valve. The diaphragm 34 moves away from the port 42 and opens the port 42 to permit gas venting action when gas pressure in the filler bowl head space 19 and connected second chamber 33 exceeds gas pressure at the gas source 21 and in the connected first valve chamber 32. Conversely, as illustrated, when the gas pressure at the gas source 21 and in the first chamber 32 is greater than the gas pressure in the second chamber 33 and associated filler bowl head space 19, the diaphragm 34 seals the gas relief port 42.

In accordance with another aspect of the invention, this valve 30 is of low cost, yet operates positively and with a minimum of part wear or operational noise. To this end, the diaphragm 34 is a multi-member diaphragm including first and second membranes 45 and 46 secured within the valve body interior 31 in the illustrated positions to cause the diaphragm to bow convexly, as illustrated, toward the relief port 42. In the illustrated embodiment, the diaphragm 34 is secured in position between two valve constituent cup-like portions 50 and 51 by a V-shaped clamp member 52 engaging cup member flanges 53 and 54. The cups 50 and 51 can be formed by drawing operations or other convenient, inexpensive fabrication methods. The cups 50 and 51 and diaphragm 34 can be held in clamped position by a locking band 55 and a convenient over-center clamp (not shown).

A planar stiffener 56 is carried between the diaphragm membranes 45 and 46 to provide a relatively planar diaphragm surface adjacent the relief to port 42 and to prohibit diaphragm ballooning into the relief port 42 when gas pressure in the first chamber 32 exceeds gas pressure in the second chamber 33. In the illustrated embodiment, uniformity of action among the diaphragm parts is encouraged by a central fastener 57, here comprising a convenient nut, bolt, and washer assembly.

In accordance with another aspect of the invention, positive valve action is encouraged, operating pressure differential is minimized and noise is reduced in this apparatus. To this end, a coil spring biasing member 60 is here included to surround the relief tube 40, and is compressed when the diaphragm 34 is closed against the relief port 42. In operation, the spring 60 urges the diaphragm 34 away from the pressure relief port 42 into a concavely bowed, pressure relieving, port-open or port-uncovered position when less than a predetermined gas pressure differential exists between the two valve chambers 32 and 33. When gas pressures within chambers 32 and 33 are equal, the diaphragm 34 will be seated on the port 42 with a force equal to the gas guage pressure in the chamber 32 times the area of the port 42, since the port itself is not pressurized. To open the port 42, a slight increase in gas pressure within the chamber 33 is required. In accordance with another feature of the invention, this increase in gas pressure within the chamber 33 can be minimized if the spring 60 is normally carried under compression and normally urges the diaphragm into an open, port-uncovered position. Valve port wear and operational noise are thus minimized.

The invention is claimed as follows:

1. A pressure stabilizer system for beverage container filling apparatus and the like having a filler bowl containing a liquid and a gas of fluctuating pressure over the liquid and a source of pressurized gas; the pressure stabilizer system including a pressure stabilizer valve comprising a valve body having a hollow interior, a diaphragm extending across the valve body interior and dividing the interior into at least two chambers, first port means in the valve body permitting pressurized gas flow between the gas pressure source and a first valve chamber, a one-way conduit connected to the pressure source and to the bowl and permitting the flow of gas from the gas pressure source to the bowl without passing through the stabilizer valve body, a check valve located in the one-way conduit between the bowl on one hand and the pressure source and pressure stabilizer valve on the other hand for checking gas flow from the bowl to the valve body first chamber and checking gas flow from the bowl directly to the source so as to isolate the stabilizer valve body and diaphragm from rapid pressure fluctuations to permit quiet sensitive valve operation, second port means in the valve body, and a two-way conduit connected to the second port means and to the filler bowl for permitting gas flow between the filler bowl and a second valve chamber, pressure relief means having a relief port permitting gas flow between the second valve chamber and the environment outside the valve and including tube means extending into the body interior and terminating in said relief port so as to locate the relief port at a position within the valve to be sealed by the diaphragm when the gas pressure in the first valve chamber urges the diaphragm toward the relief port, yet permitting the relief port to be unsealed by the diaphragm when the gas pressure in the second valve chamber urges the diaphragm away from the relief port and diaphragm spring biasing means engaging the diaphragm and urging the diaphragm away from the pressure relief port to further assist in encouraging quiet, sensitive valve operation.

2. A pressure stabilizer system according to claim 1 wherein said valve includes a multi-member diaphragm including first and second diaphragm members and the valve further includes means for securing the diaphragm members within the valve body interior in positions to cause the diaphragm to bow convexly toward the relief port, and planar diaphragm stiffener means carried between the diaphragm members for providing a relatively planar diaphragm surface adjacent the relief port.

3. A pressure stabilizer system according to claim 2 wherein said pressure stabilizer valve body comprises at least two matable parts, and including clamp means for clamping the diaphragm members between the two body parts in position to cause said convexly bowed diaphragm configuration.

4. A pressure stabilizer system according to claim 1 wherein said pressure stabilizer valve diaphragm spring biasing means comprises a coil spring surrounding said tube means and engaging the diaphragm, the spring being compressed when the diaphragm is closed against the pressure relief port and urging the diaphragm away from the pressure relief port into a pressure-relieving, port-open position.

5. A pressure stabilization system for beverage container filling apparatus and the like, comprising: a filler bowl containing gas of a fluctuating pressure, a source of pressurized gas, a pressure stabilizer valve, the stabilizer valve including a hollow valve body, a diaphragm inside the valve body and dividing the body interior into at least ported and unported chambers, tube means extending through the valve body and into the ported chamber and terminating in a relief port inside the ported chamber, the relief port means in the ported chamber being normally closed by the diaphragm but operable by diaphragm movement to vent gas to the environment outside the valve, spring biasing means in the valve for urging the diaphragm away from the relief port, the system further including a first conduit connected to and permitting flow of gas between the pressurized gas source and the unported valve body chamber to maintain said unported chamber at said gas source gas pressure, and a second conduit connected directly between the filler bowl and the second ported chamber and permitting flow of gas between the filler bowl and the second ported chamber, whereby the valve relief port means is opened by diaphragm port uncovering action and gas venting occurs when the force on the diaphragm exerted by gas pressure in the filler bowl and second ported valve chamber and by the spring biasing means exceeds the force on the diaphragm exerted by gas pressure at the gas source and in the first unported valve chamber, the system further including a one-way conduit connected directly between the gas source and the bowl, without passing through the stabilizer valve, and a check valve operatively included in the one-way conduit adjacent the bowl permitting the flow of pressurized gas from the source to the bowl without passing through the stabilizer valve but checking gas flow from the bowl to the source and to the unported valve body chamber so as to isolate the valve body from rapid pressure fluctuations and to permit quiet, sensitive valve operation.

6. A pressure system according to claim 5 including means causing the diaphragm member to bow convexly toward and to cover said relief port means when pressures in said two chambers are substantially equal, and diaphragm planar stiffener means for inhibiting diaphragm ballooning into the relief port means when gas pressure in the unported chamber exceeds gas pressure in the ported chamber.

* * * * *